US008646657B2

(12) United States Patent
Hsu et al.

(10) Patent No.: US 8,646,657 B2
(45) Date of Patent: Feb. 11, 2014

(54) ELECTRIC CAULKING GUN

(75) Inventors: Chih-Hua Hsu, Taichung (TW); Cheng-Yuan Lin, Taichung (TW); Chen-Chen Cheng, Taichung (TW); Rui-Heng Lin, Taichung (TW)

(73) Assignee: Techway Industrial Co., Ltd., Taichung (TW)

( * ) Notice: Subject to any disclaimer, the term of this patent is extended or adjusted under 35 U.S.C. 154(b) by 3 days.

(21) Appl. No.: 13/448,844

(22) Filed: Apr. 17, 2012

(65) Prior Publication Data

US 2013/0270302 A1 Oct. 17, 2013

(51) Int. Cl.
*B65D 88/54* (2006.01)

(52) U.S. Cl.
USPC ..... 222/63; 222/333; 222/386; 222/390

(58) Field of Classification Search
USPC ..... 222/333, 327, 137, 376.1, 390, 386, 222/571, 262, 63; 318/280; 74/10.52, 52, 74/575, 577 R, 576, 578
See application file for complete search history.

(56) References Cited

U.S. PATENT DOCUMENTS 4,583,934 A * 4/1986 Hata et al. ..... 425/376.1
4,615,469 A * 10/1986 Kishi et al. ..... 222/327
5,775,539 A * 7/1998 Bates et al. ..... 222/1
5,909,830 A * 6/1999 Bates et al. ..... 222/327
7,116,071 B2 * 10/2006 Glasgow et al. ..... 318/280
7,249,695 B2 * 7/2007 Shew ..... 222/333
7,637,392 B2 * 12/2009 Hsu et al. ..... 222/137
7,997,456 B2 * 8/2011 Shew et al. ..... 222/333
8,020,727 B2 * 9/2011 Herman et al. ..... 222/1
8,387,825 B2 * 3/2013 Herman et al. ..... 222/1
8,573,450 B2 * 11/2013 Hsu et al. ..... 222/333
2009/0039113 A1 2/2009 Hsu et al.
2011/0068130 A1 * 3/2011 Mitrovic et al. ..... 222/386
2011/0151042 A1 * 6/2011 Strobel-Schmidt et al. .. 425/145
2013/0043281 A1 * 2/2013 Hsu et al. ..... 222/333

FOREIGN PATENT DOCUMENTS

DE 20 2007 017880 U1 3/2008

* cited by examiner

*Primary Examiner* — Kevin P Shaver
*Assistant Examiner* — Michael J Melaragno
(74) *Attorney, Agent, or Firm* — Ming Chow; Sinorica, LLC

(57) ABSTRACT

An electric caulking gun has a body and an actuating assembly. The body has a pushing shaft, a motor, a gearbox, a transmission device, a circuit board and a switch. The gearbox has a sun gear with multiple mounting slots. The actuating assembly is mounted in the body, is connected to the switch and engages the sun gear and has a connecting arm, a linking arm, an actuating element, an oscillating arm and a pressing button. The connecting arm is pivotally connected to the switch. The linking arm is connected to the connecting arm. The actuating element is mounted in the body, selectively engages one of the mounting slots and has a wedge mount and an engaging block. The oscillating arm is connected to the body and is connected to the connecting arm. The pressing button is movably mounted in the body and is connected to the oscillating arm.

9 Claims, 8 Drawing Sheets

ELECTRIC CAULKING GUN

BACKGROUND OF THE INVENTION

1. Field of the Invention

The present invention relates to a caulking gun, and more particularly relates to an electric caulking gun that can be used conveniently.

2. Description of Related Art

With reference to FIG. 8, a conventional caulking gun comprises a caulking barrel 51, a handle 52, a pressing stem 53 and a pushing shaft 54. The caulking barrel 51 is used to hold with a caulking tube. The handle 52 is formed with a rear end of the caulking barrel 51 for a user to grip. The pressing stem 53 is pressably connected between the caulking barrel 51 and the pressing stem 52. The pushing shaft 54 is movably mounted in the caulking barrel 51 to push the caulking tube and has a unidirectional drive ring 541 and a release arm 542. The unidirectional drive ring 541 is mounted around the pushing shaft 54, presses against the pressing stem 53 to push the pushing shaft 54 to move relative to the caulking barrel 51 and to press the caulking tube by the pressing stem 53. The release arm 542 is mounted around the pushing shaft 54 and presses against the pushing shaft 54 to enable the pushing shaft 54 to move along a single direction.

The conventional caulking gun 50 can be used to make the gel flow out of the caulking tube by pressing the pressing stem 53 to enable the unidirectional drive ring 541 to move and to make the pushing shaft 54 move forward. However, the unidirectional drive ring 541 only can be moved along a single direction and the atmospheric pressure that exists out of the caulking tube cannot resist the pressing force of the immobile pushing shaft 54 to prevent the gel from flow out the caulking tube when the user releases the pressing stem 53. Then, the gel may flow out of the caulking tube after the user releasing the pressing stem 53. This may cause the working place dirty and waste the gel of the caulking tube and inconvenient in use.

To overcome the shortcomings, the present invention provides an electric caulking gun to mitigate or obviate the aforementioned problems.

SUMMARY OF THE INVENTION

The main objective of the present invention is to provide an electric caulking gun that can be used conveniently.

The electric caulking gun in accordance with the present invention has a body and an actuating assembly. The body has a pushing shaft, a motor, a gearbox, a transmission device, a circuit board and a switch. The gearbox is mounted in the body, is connected to the pushing shaft and the motor and has a sun gear with multiple mounting slots. The circuit board is mounted in the body and is electrically connected to the motor and the transmission. The switch is pressably connected to the body. The actuating assembly is mounted in the body, is connected to the switch and selectively engages the sun gear and has a connecting arm, a linking arm, an actuating element, an oscillating arm and a pressing button. The connecting arm is mounted in the body and is pivotally connected to the switch. The linking arm is pivotally connected to the body and is connected to the connecting arm. The actuating element is movably mounted in the body, selectively engages one of the mounting slots of the sun gear and has a wedge mount and an engaging block. The oscillating arm is pivotally connected to the body and is connected to the connecting arm. The pressing button is movably and pressably mounted in the body and is connected to the oscillating arm.

Other objects, advantages and novel features of the invention will become more apparent from the following detailed description when taken in conjunction with the accompanying drawings.

DETAILED DESCRIPTION OF THE PREFERRED EMBODIMENT

Figure 1:
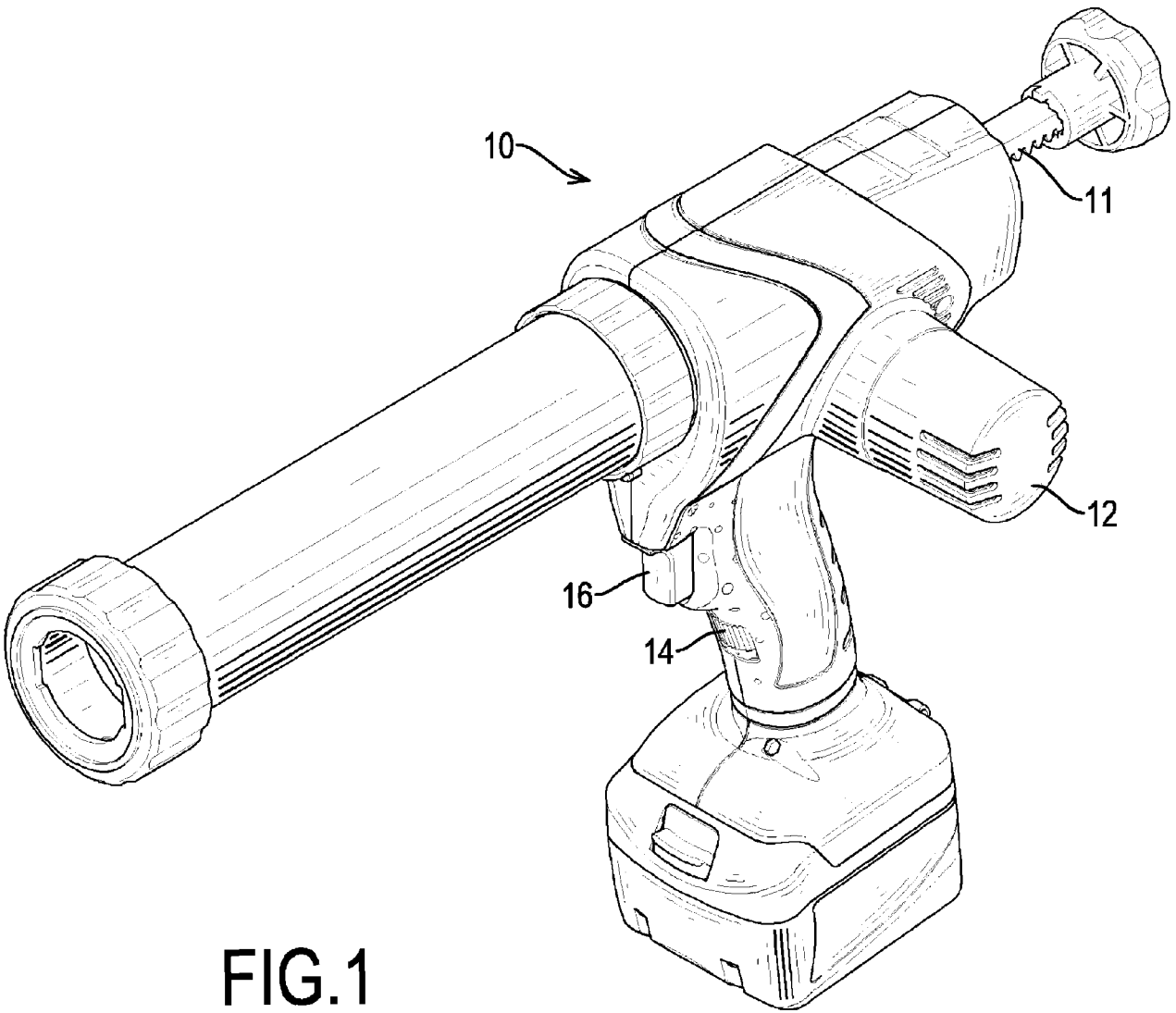
FIG. 1 is a perspective view of an electric caulking gun in accordance with the present invention.
Figure 2:
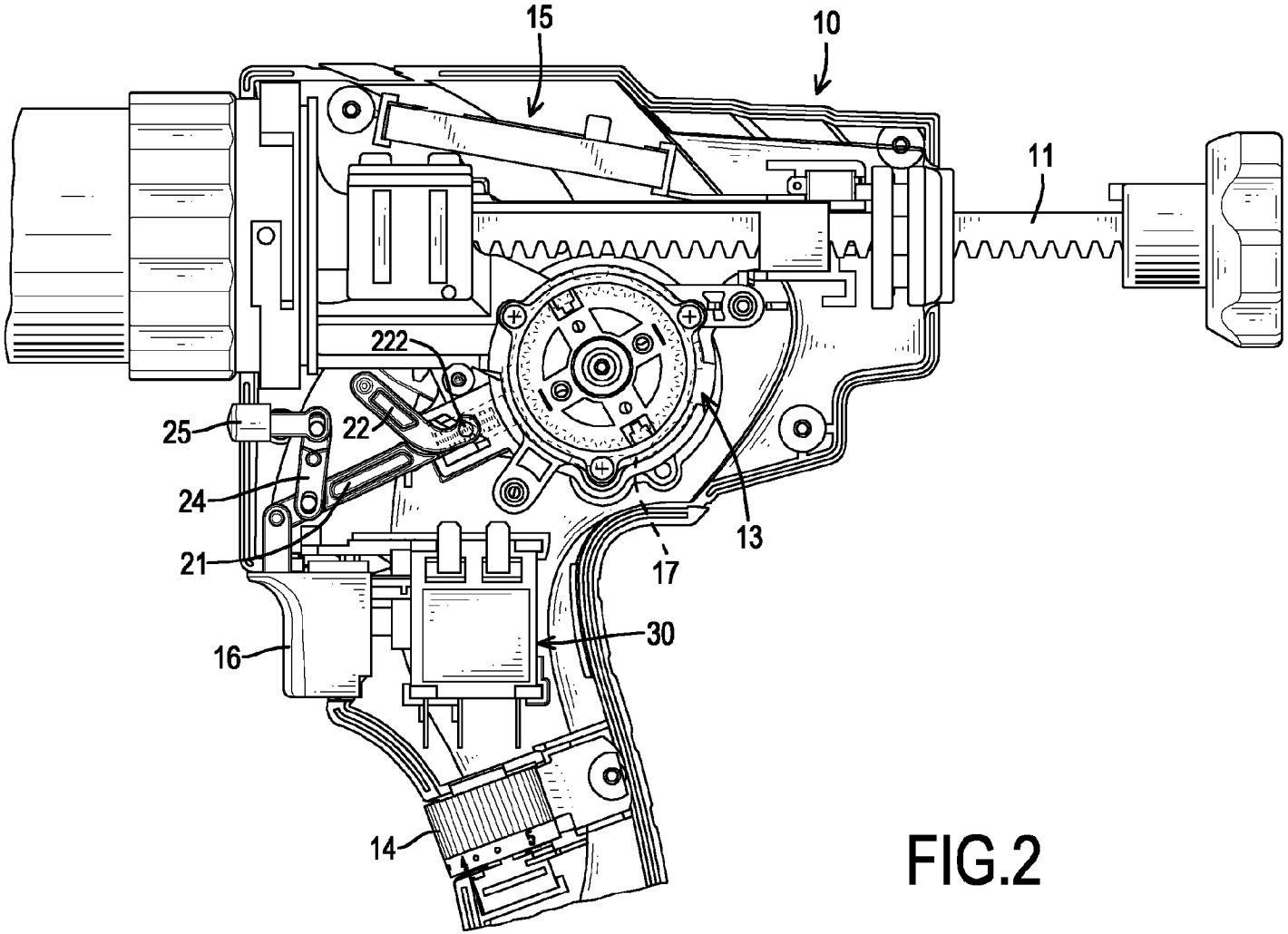
FIG. 2 is an enlarged partial side view of the electric caulking gun in FIG. 1.
Figure 3:
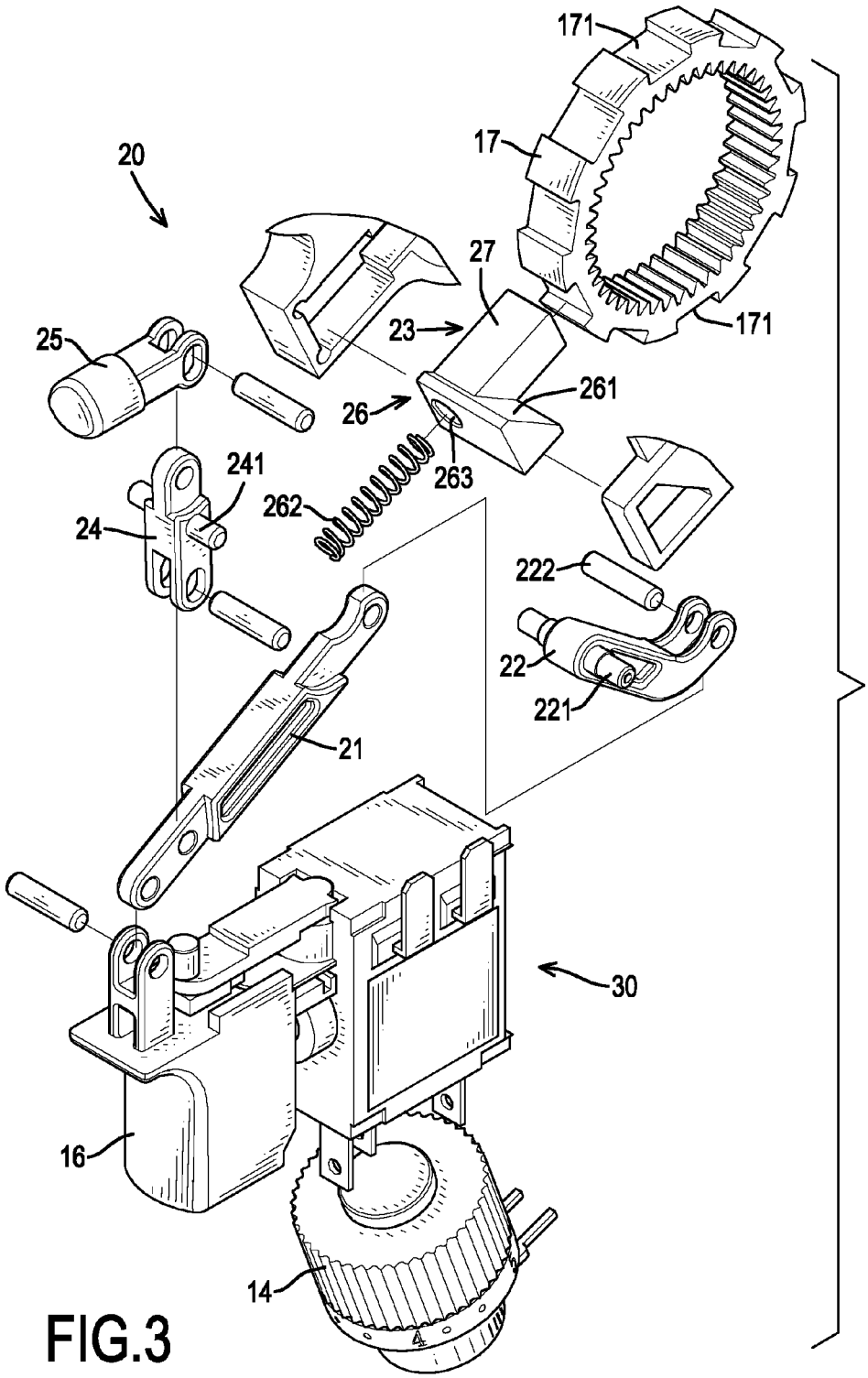
FIG. 3 is a partially exploded perspective view of the electric caulking gun in FIG. 1.

With reference to FIGS. 1 to 3, an electric caulking gun in accordance with the present invention comprises a body 10, an actuating assembly 20 and a speed control device 30.

The body 10 has a front end, a rear end, a side, a lower end, a pushing shaft 11, a motor 12, a gearbox 13, a transmission device 14, a circuit board 15 and a switch 16. The pushing shaft 11 is movably connected to the rear end of the body 10 to push a caulking tube that is mounted in the body 10. The motor 12 is mounted on the side of the body 10 to provide a power to the pushing shaft 11 to enable the pushing shaft 11 to move relative to the body 10.

The gearbox 13 is mounted in the body 10, is connected to the pushing shaft 11 and the motor 12 and has a sun gear 17 and multiple planet gears. The sun gear 17 is rotatably mounted in the body 10 and has an external surface, an internal surface, multiple mounting slots 171 and multiple engaging teeth. The mounting slots 171 are formed in the external surface of the sun gear 17 at intervals. The engaging teeth are formed around the internal surface of the sun gear 17 to form the sun gear 17 as an inner gear. The planet gears engage the engaging teeth of the sun gear 17 and are connected to the motor 12. In addition, the gearbox 13 may further has multiple gear sets connected between the sun gear 17, the motor 12 and the pushing shaft 11. Then, the power of the motor 12 can be transmitted to the pushing shaft 11 via the gearbox 13.

The transmission device 14 is rotatably mounted in the body 10 near the lower end of the body 10. The circuit board 15 is mounted in the body 10 above the gearbox 13 and is electrically connected to the motor 12 and the transmission device 14. Then, the rotating speed of the motor 12 can be adjusted by the transmission device 14 via the circuit board 15 and the moving speed of the pushing shaft 11 also can be adjusted accordingly. The switch 16 is pressably connected to the body 10 above the gearbox 13 and has a top.

Figure 4:
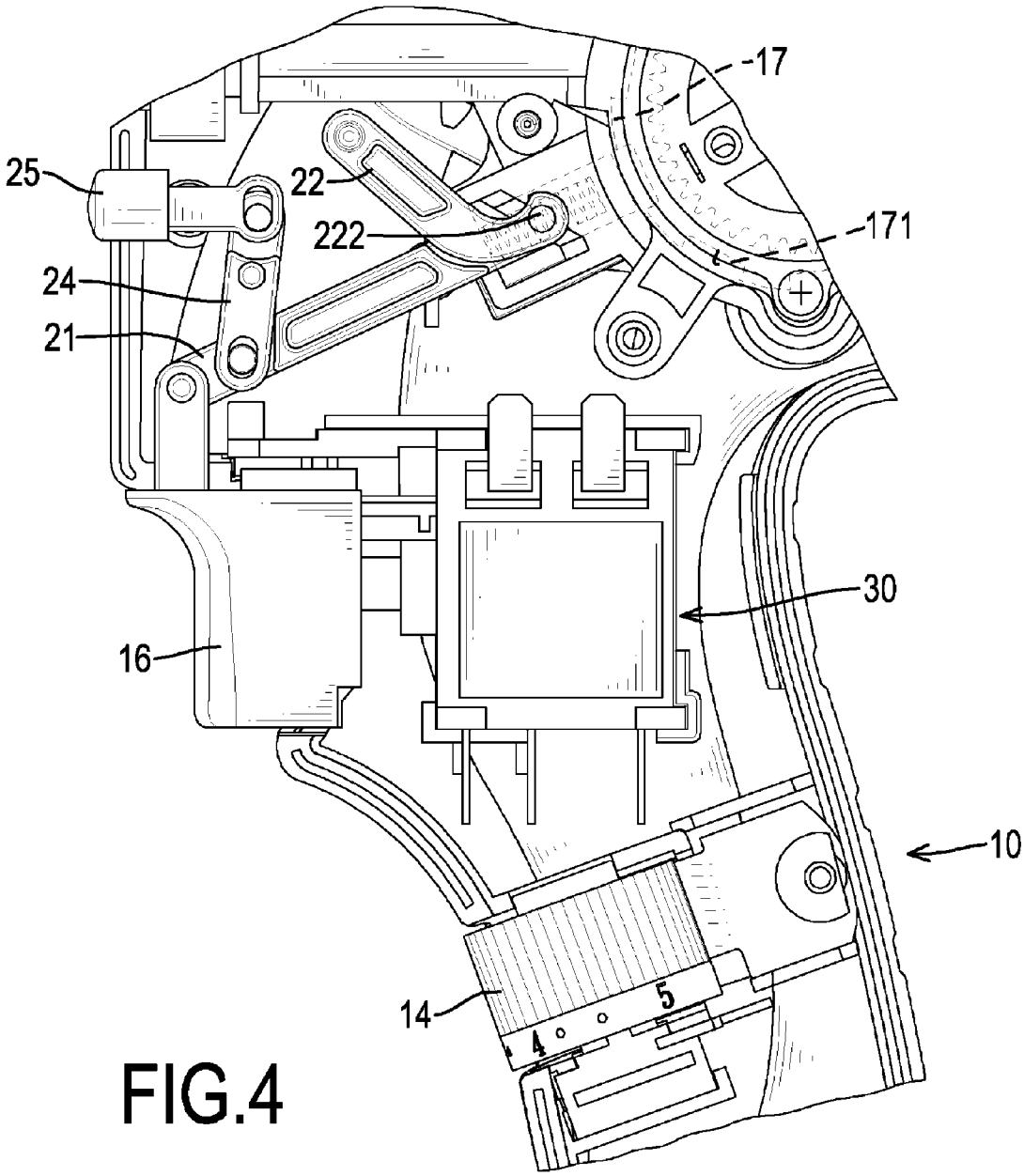
FIG. 4 is another enlarged partial side view of the electric caulking gun in FIG. 1.
Figure 7:
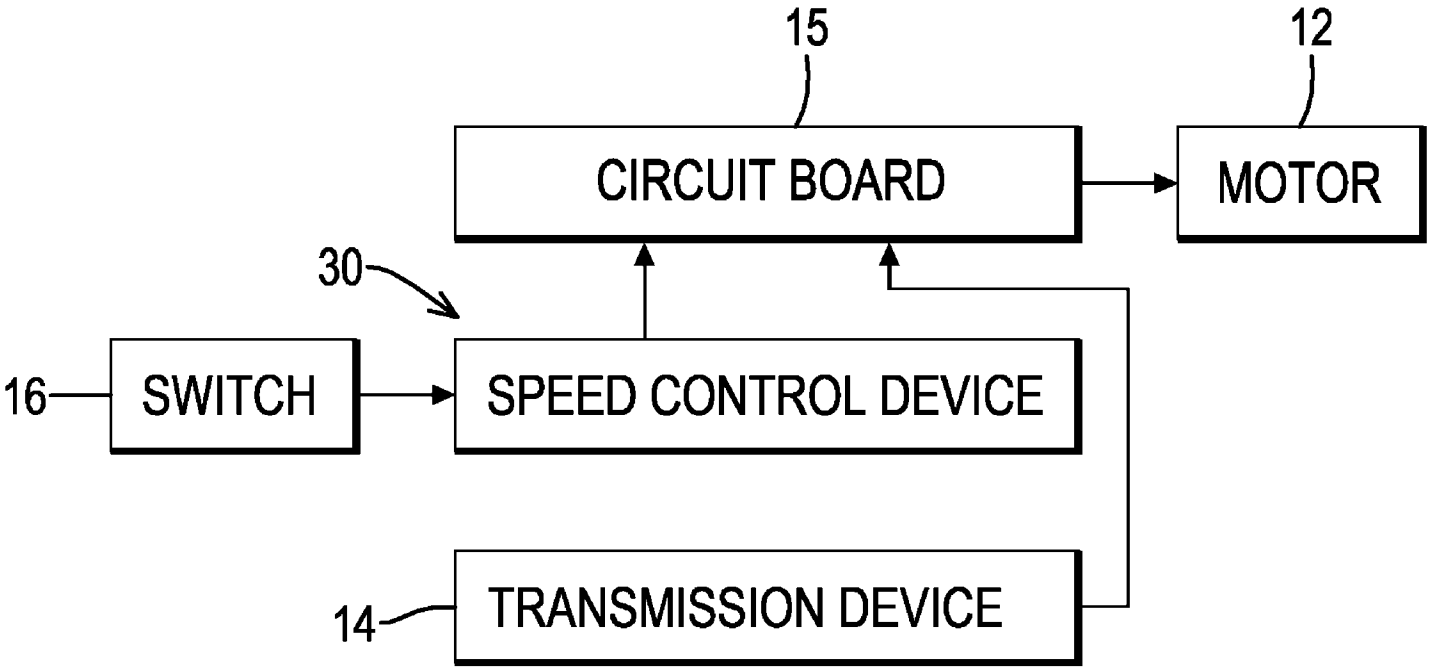
FIG. 7 is a block diagram of the electrical connection of the electric caulking gun in FIG. 1.
Figure 8:
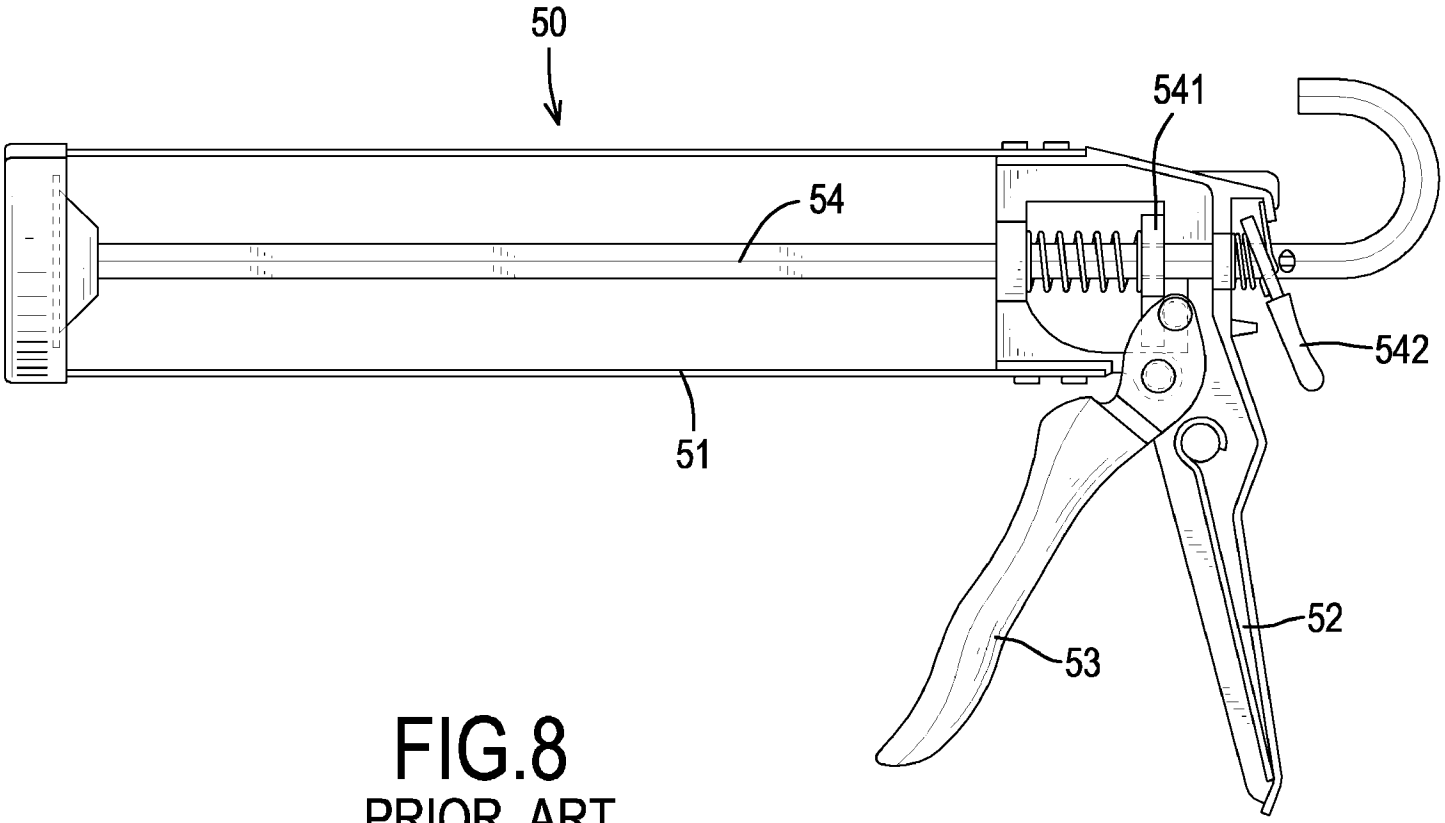
FIG.8 PRIOR ART
FIG. 8 is a side view of a conventional caulking gun in accordance with the prior art.

With reference to FIGS. 3, 4 and 7, the actuating assembly 20 is mounted in the body 10, is connected to the switch 16 and selectively engages the sun gear 17 of the gearbox 13. The actuating assembly 20 has a connecting arm 21, a linking arm 22, an actuating element 23, an oscillating arm 24 and a pressing button 25.

The connecting arm 21 is mounted in the body 10, is pivotally connected to the switch 16 and has a lower end and an upper end. The lower end of the connecting arm 21 is pivotally connected to the top of the switch 16. The upper end of the connecting arm 21 extends upwardly to the sun gear 17 of the gearbox 13.

The linking arm 22 is curved, is pivotally connected to the body 10 and is connected to the connecting arm 21. The linking arm 22 has a straight end, a curved end, a pivotal rod 221 and a pushing rod 222. The pivotal rod 221 is transversally formed on and protrudes from the straight end of the linking arm 22 and is pivotally connected to the body 10 above the connecting arm 21. The pushing rod 222 is connected to the curved end of the linking arm 22 and the upper end of the connecting arm 21 and has an abutting end. The abutting end of the pushing rod 222 transversally extends out of the curved end of the linking arm 22 and extends toward the sun gear 17 of the gearbox 13.

The actuating element 23 is movably mounted in the body 10, selectively engages one of the mounting slots 171 of the sun gear 17 and has a wedge mount 26 and an engaging block 27. The wedge mount 26 may be trapezoidal, is movably mounted in the body 10 and has an outer surface, an inner surface, a wedge face 261, a spring 262 and a mounting recess 263. The inner surface of the wedge mount 26 faces the external surface of the sun gear 17. The wedge face 261 is obliquely formed on the inner surface of the wedge mount 16 and abuts against the abutting end of the pushing rod 222. The spring 262 is mounted between the body 10 and the outer surface of the wedge mount 26 to push the wedge mount 16 to move toward the sun gear 17. The mounting recess 263 is formed in the outer surface of the wedge mount 16, and the spring 262 is mounted partially in the mounting recess 263.

The engaging block 27 may be quadrate, is formed on and protrudes from the outer surface of the wedge mount 16 adjacent to the wedge face 261 and selectively engages one of the mounting slots 171 of the sun gear 17.

The oscillating arm 24 is pivotally connected to the body 10, is connected to the connecting arm 21 and has a middle, a bottom end, a top end and a pivotal bar 241. The middle of the oscillating arm 24 is pivotally connected to the body 10 above the connecting arm 21. The bottom end of the oscillating arm 24 extends downwardly adjacent to the lower end of the connecting arm 21. The pivotal bar 241 is mounted between the bottom end of the oscillating arm 24 and the connecting arm 21 above the switch 16 to enable the oscillating arm 24 to pivot relative to the body 10.

The pressing button 25 is movably and pressably mounted in the body 10, is connected to the oscillating arm 24 and has an inner end and an outer end. The inner end of the pressing button 25 is connected to the top end of the oscillating arm 24. The outer end of the pressing button 25 extends out of the body 10.

The speed control device 30 is mounted in the body 10 below the actuating assembly 20, is electrically connected to the circuit board 15 and the switch 16 of the body 10. When the rotating speed of the motor 12 is adjusted by the transmission device 14 at a specific value, the speed control device 30 can be used to gradually increase the rotating speed of the motor 12 to the specific value according to the pressing degree of the switch 16.

Figure 5:
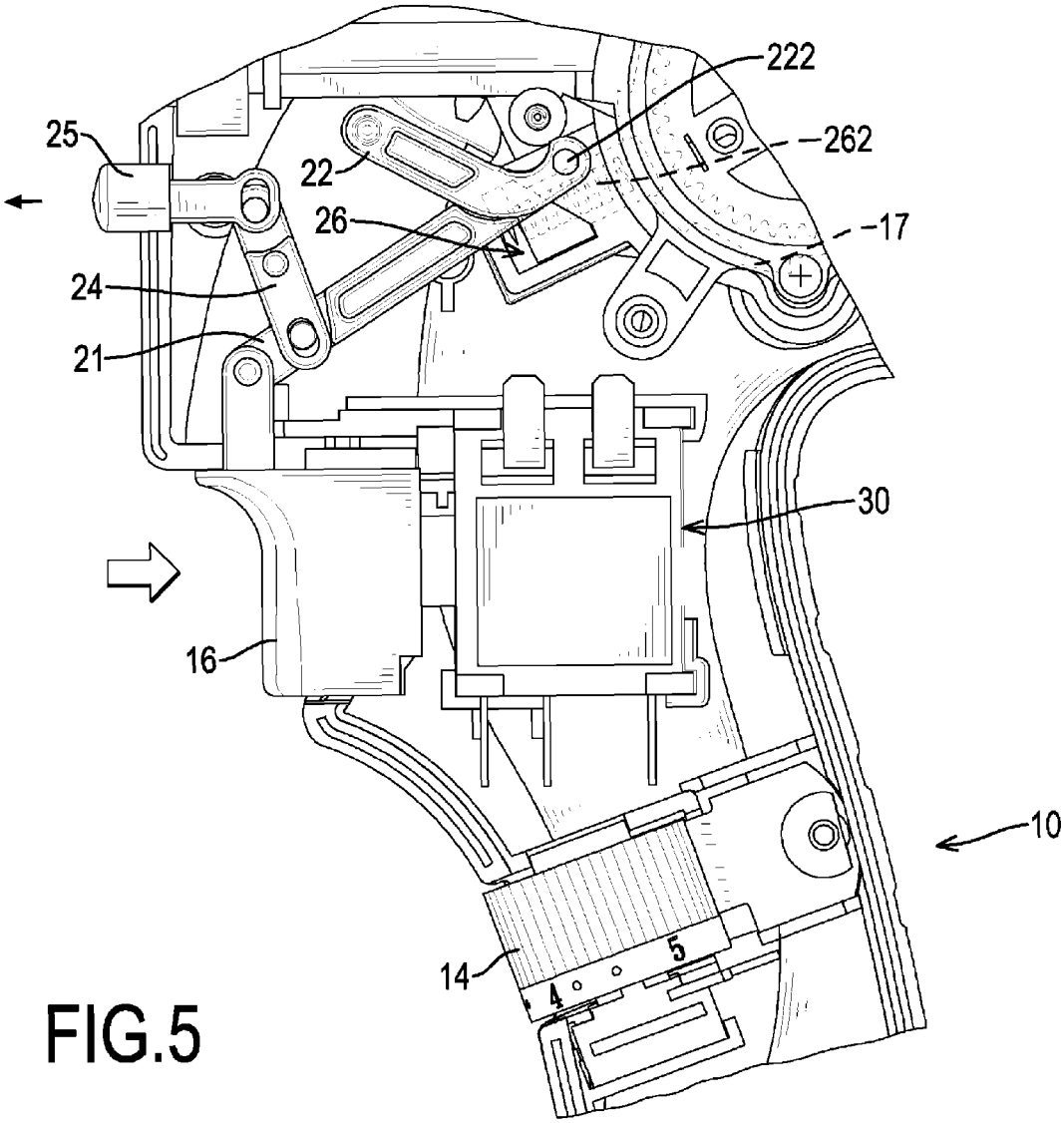
FIG. 5 is an operational partial side view of the electric caulking gun in FIG. 1.

In use, with reference to FIG. 4, the engaging block 27 of the actuating element 23 normally disengages from the sun gear 17 of the gearbox 13. With reference to FIGS. 3 and 5, when pressing the switch 16, the connecting arm 21 will move inwardly with the switch 16 and will oscillate relative to the body 10 due to the connection between the connecting arm 21 and the oscillating arm 24. Then, the linking arm 22 will take the pivotal rod 221 as a pivot and will pivot in a counterclockwise direction relative to the body 10. When the linking arm 22 pivots relative to the body 10, the pushing rod 222 will move upwardly along the wedge face 261 of the wedge mount 26. As the pushing rod 222 moves upwardly along the wedge face 261 of the wedge mount 26, the spring 262 will push the wedge mount 26 upwardly to enable the engaging block 27 to engage one of the mounting slots 171 of the sun gear 17. Then, the sun gear 17 is fixed and the power of the motor 12 can be transmitted to the pushing shaft 11 via the gearbox 13. The gel of a caulking tube that is mounted in the front end of the body 10 can be flowed out of the caulking tube by the movement of the pushing shaft 11.

In addition, when the engaging block 27 of the actuating element 23 engages one of the mounting slots 171 of the sun gear 17, the oscillating arm 24 will move with the connecting arm 21 and takes the middle of the oscillating arm 24 as a pivot to pivot in a counterclockwise direction relative to the body 10. When the oscillating arm 24 rotates relative to the body 10, the top end of the oscillating arm 24 will push the pressing button 25 outwardly relative to the body 10 as shown in FIG. 5.

Figure 6:
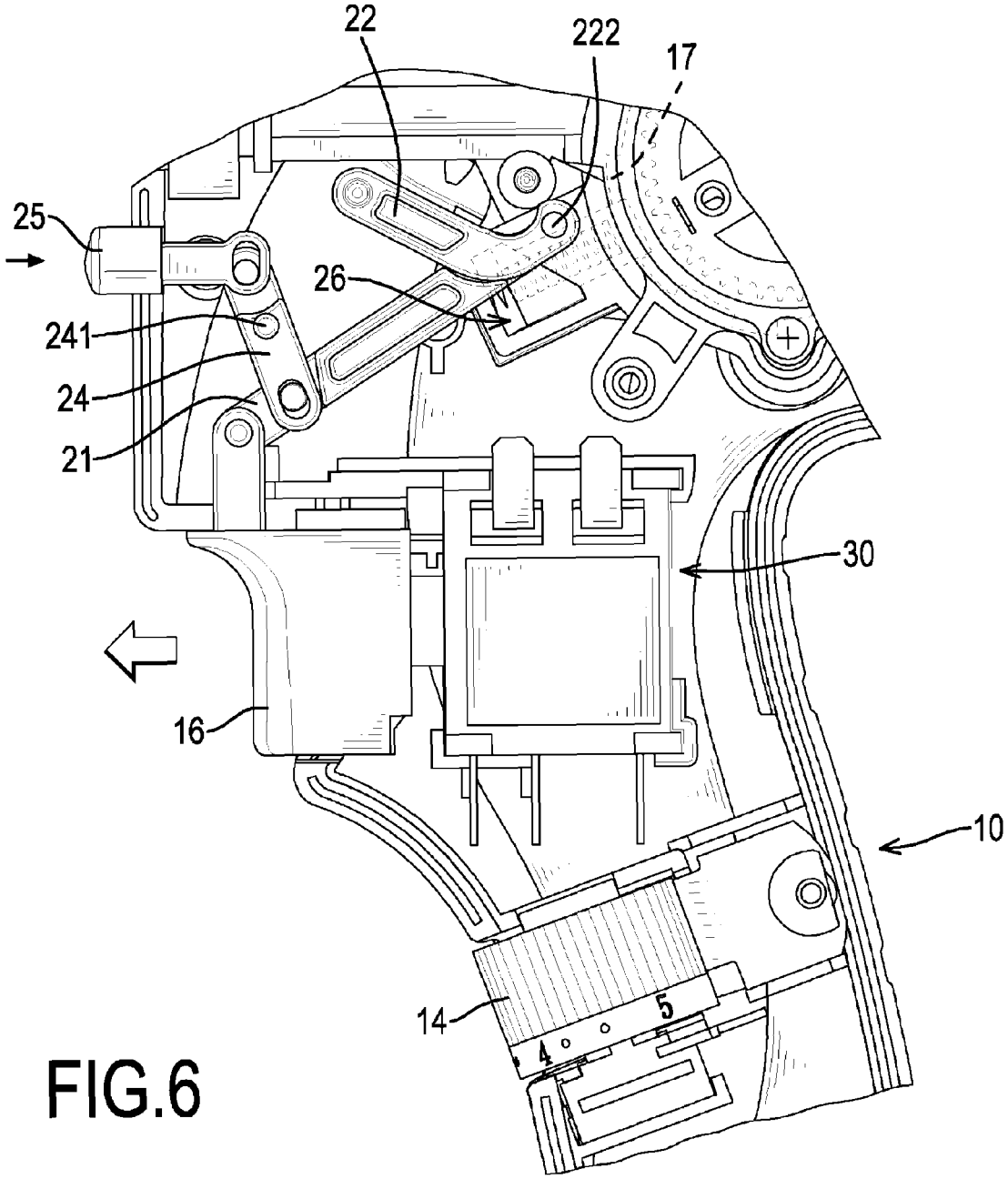
FIG. 6 is another operational partial side view of the electric caulking gun in FIG. 1.

With further reference to FIG. 6, when the user releases the switch 16 to stop injecting the gel from the caulking tube, the switch 16 will move backward to the original position. At the same time, the connecting arm 21 will be pivoted due to the movement of the switch 16 to enable the linking arm 22 to pivot in a clockwise direction relative to the body 10. Then, the pushing rod 222 will move downwardly along the wedge face 261 to press and push the wedge mount 26 to move back the original position and press the spring 262. Therefore, the engaging block 27 will move backwardly with the wedge mount 26 and disengages from the corresponding mounting slot 171 of the sun gear 17 to enable the sun gear 17 to rotate freely. Then, the pushing shaft 11 can be moved backward by the idle running of the sun gear 17 and the gel can be flow back this can prevent the gel from flowing out the caulking tube while the electric caulking gun is not in use.

In addition, with reference to FIG. 6, when the engaging block 27 disengages from the corresponding mounting slot 171 of the sun gear 17, the oscillating arm 24 will pivot in a clockwise direction to the original position and the top end of the oscillating arm 24 will pull the inner end of the pressing button 25 to move inward the body 10. At this time, in order to prevent the engaging block 27 unascertained disengaging from the corresponding mounting slot 171 of the sun gear 17, the user can press the outer end of the pressing button 25 again after the pressing button 25 returns the original position and this can enable the pressing button 25 to push the oscillating arm 24, the connecting arm 21 and the linking arm 22 in sequence. Then, the engaging block 27 of the actuating element 23 can be pressed assuredly to disengage from the corresponding mounting slot 171 of the sun gear 17. When the engaging block 27 of the actuating element 23 is assuredly departed from the corresponding mounting slot 171 of the sun gear 17, the sun gear 17 can be rotated freely. Then, the pushing shaft 11 can be moved backwardly relative to the body 10. When the sun gear 17 can be rotated freely to enable the pushing shaft 11 to move relative to the body 10, the atmospheric pressure that exists out of the caulking tube can resist the pressing force of the pushing shaft 11 to push the gel to flow back the caulking tube and this can prevent the gel from flow out the caulking tube when the user releases the switch 16.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electric caulking gun having:

a body having a front end;

a rear end;

a side;

a lower end;

a pushing shaft movably connected to the rear end of the body to push a caulking tube;

a motor mounted on the side of the body to provide a power to the pushing shaft to enable the pushing shaft to move relative to the body;

a gearbox mounted in the body, connected to the pushing shaft and the motor to transmit the power of the motor to the pushing shaft and having a sun gear rotatably mounted in the body and having an external surface;

an internal surface;

multiple mounting slots formed in the external surface of the sun gear at intervals; and multiple engaging teeth formed around the internal surface of the sun gear to form the sun gear as an inner gear;

a transmission device rotatably mounted in the body near the lower end of the body;

a circuit board mounted in the body above the gearbox and electrically connected to the motor and the transmission device; and a switch pressably connected to the body below the gearbox and having a top; and an actuating assembly mounted in the body, connected to the switch and selectively engaging the sun gear of the gearbox and having a connecting arm mounted in the body, pivotally connected to the switch and having a lower end pivotally connected to the top of the switch; and an upper end extending upwardly to the sun gear of the gearbox;

a linking arm being curved, pivotally connected to the body and connected to the connecting arm and having a straight end pivotally connected to the body above the connecting arm;

a curved end; and a pushing rod connected to the curved end of the linking arm and the upper end of the connecting arm and having an abutting end transversally extending out of the curved end of the linking arm and extending toward the sun gear of the gearbox;

an actuating element movably mounted in the body, selectively engaging one of the mounting slots of the sun gear and having a wedge mount movably mounted in the body and having an outer surface;

an inner surface facing the external surface of the sun gear;

a wedge face obliquely formed on the inner surface of the wedge mount and abutting against the abutting end of the pushing rod; and a spring mounted between the body and the outer surface of the wedge mount to push the wedge mount to move toward the sun gear; and an engaging block formed on and protruding from the outer surface of the wedge mount adjacent to the wedge face and selectively engaging one of the mounting slots of the sun gear;

an oscillating arm pivotally connected to the body, connected to the connecting arm and having a middle pivotally connected to the body above the connecting arm;

a bottom end extending downwardly adjacent to the lower end of the connecting arm; and a top end; and a pressing button movably and pressably mounted in the body, connected to the oscillating arm and having an inner end connected to the top end of the oscillating arm; and an outer end extending out of the body.

2. The electric caulking gun as claimed in claim 1, wherein the electric caulking gun has a speed control device mounted in the body below the actuating assembly, electrically connected to the circuit board and the switch of the body to gradually increase the rotating speed of the motor to a specific value according to the pressing degree of the switch.

3. The electric caulking gun as claimed in claim 2, wherein the linking arm has a pivotal rod transversally formed on and protruding from the straight end of the linking arm and rotatably connected to the body above the connecting arm.

4. The electric caulking gun as claimed in claim 3, wherein the oscillating arm has a pivotal bar mounted between the bottom end of the oscillating arm and the connecting arm above the switch to enable the oscillating arm to pivot relative to the body.

5. The electric caulking gun as claimed in claim 4, wherein the wedge mount has a mounting recess formed in the outer surface of the wedge mount for the spring to be mounted partially in the mounting recess of the wedge mount.

6. The electric caulking gun as claimed in claim 5, wherein the wedge mount is trapezoidal; and the engaging block is quadrate.

7. The electric caulking gun as claimed in claim 1, wherein the oscillating arm has a pivotal bar mounted between the bottom end of the oscillating arm and the connecting arm above the switch to enable the oscillating arm to pivot relative to the body.

8. The electric caulking gun as claimed in claim 1, wherein the wedge mount has a mounting recess formed in the outer surface of the wedge mount for the spring to be mounted partially in the mounting recess of the wedge mount.

9. The electric caulking gun as claimed in claim 1, wherein the wedge mount is trapezoidal; and the engaging block is quadrate.

* * * * *